US011183068B2

(12) United States Patent
Bhunia et al.

(10) Patent No.: US 11,183,068 B2
(45) Date of Patent: Nov. 23, 2021

(54) MULTI-PURPOSE CONTEXT-AWARE BUMP (CAB) SUPPORTING DYNAMIC ADAPTATION OF FORM FACTORS AND FUNCTIONALITY

(71) Applicant: University of Florida Research Foundation, Inc., Gainesville, FL (US)

(72) Inventors: Swarup Bhunia, Gainesville, FL (US); Prabuddha Chakraborty, Gainesville, FL (US); Lili Du, Gainesville, FL (US); Sandip Ray, Gainesville, FL (US)

(73) Assignee: University of Florida Research Foundation, Incorporated, Gainesville, FL (US)

( * ) Notice: Subject to any disclaimer, the term of this patent is extended or adjusted under 35 U.S.C. 154(b) by 0 days.

(21) Appl. No.: 16/885,642

(22) Filed: May 28, 2020

(65) Prior Publication Data

US 2020/0380868 A1 Dec. 3, 2020

Related U.S. Application Data

(60) Provisional application No. 62/853,932, filed on May 29, 2019.

(51) Int. Cl.

| | |
|---|---|
| ***G08G 1/16*** | (2006.01) |
| ***G08G 1/09*** | (2006.01) |
| ***E01F 9/529*** | (2016.01) |

(52) U.S. Cl.

CPC ..... *G08G 1/166* (2013.01); *E01F 9/529* (2016.02); *G08G 1/09* (2013.01)

(58) Field of Classification Search

CPC ..... G08G 1/01; G08G 1/0112; G08G 1/0116; G08G 1/09; G08G 1/091; G08G 1/166;

(Continued)

(56) References Cited

U.S. PATENT DOCUMENTS 6,457,900 B2 10/2002 Bond
10,570,576 B1 * 2/2020 Mothafar ..... E01F 9/529

(Continued)

OTHER PUBLICATIONS

Antic et al., "The influence of speed bumps heights to the decrease of the vehicle speed-belgrade experience", Safety Science, 57:303-312, 2013.

(Continued)

*Primary Examiner* — Van T Trieu

(74) *Attorney, Agent, or Firm* — Thomas | Horstemeyer, LLP

(57) ABSTRACT

Various examples are provided related to multi-purpose context-aware bumps (CABs) that can support dynamic adaptation of form factors and functionality. In one example, a CAB system can include sensors distributed in a traffic network and communicatively coupled to a remotely located computing environment; context-aware bumps (CABs) placed in the traffic network and communicatively coupled to the remotely located computing environment; and a CAB application configured to adjust a form factor of a CAB in response to information obtained from the sensors and/or CABs. In another example, a method can include receiving, by a remotely located computing environment, traffic information from sensors distributed in a traffic network or CABs placed in the traffic network; communicating, by the remotely located computing environment, a form factor control to a CAB in response to the traffic information; and adjusting a form factor of the CAB in response to the form factor control.

20 Claims, 8 Drawing Sheets

(58) Field of Classification Search
CPC ..... G08G 1/167; G08G 1/16; E01C 23/09; E01C 23/00; E01F 9/00; E01F 9/04; E01F 9/047; E01F 9/529
See application file for complete search history.

(56) References Cited

U.S. PATENT DOCUMENTS

| | | | | |
|---|---|---|---|---|
| 2009/0160675 | A1* | 6/2009 | Piccinini | G08G 1/127 340/905 |
| 2016/0312416 | A1* | 10/2016 | Shi | E01F 9/529 |
| 2019/0027036 | A1* | 1/2019 | Mishina | G01C 21/3492 |
| 2020/0152053 | A1* | 5/2020 | Rogers | G08G 1/0116 |

OTHER PUBLICATIONS

Domonoske, "Pedestrian fatalities remain at 25-year high for second year in a row", NPR, Feb. 28, 2018.
Lan et al., "Effect of Height and Width of Road Humps on Deceleration Performance and Driving Safety", Applied Mechanics and Materials, 2013, vol. 483. pp. 330-336.
Salau et al., "Vehicle speed control using road bumps", Transport, 2004, 19(3):130-136.

* cited by examiner

MULTI-PURPOSE CONTEXT-AWARE BUMP (CAB) SUPPORTING DYNAMIC ADAPTATION OF FORM FACTORS AND FUNCTIONALITY

CROSS REFERENCE TO RELATED APPLICATIONS

This application claims priority to, and the benefit of, U.S. provisional application entitled "Multi-Purpose Context-Aware Bump (CAB) Supporting Dynamic Adaptation of Form Factors and Functionality" having Ser. No. 62/853,932, filed May 29, 2019, which is hereby incorporated by reference in its entirety.

BACKGROUND

Based on recent reports, pedestrian fatalities remain at 25 years high for the second year in a row in USA. Similar trends are observed in other parts of the globe. Florida is the deadliest state in terms of pedestrian deaths due to cars hitting pedestrians in cross-sections, based on the reports for 2016 and 2017. The primary reasons for this trend in Florida include: (1) more SUVs on the road; (2) more people crossing the road on foot; (3) average age of people on road being higher; and (4) higher average speed of cars. Traffic signal/control system is not sufficient to deal with this problem and even static speed bumps fail to stop reckless drivers.

SUMMARY

Aspects of the present disclosure are related to multi-purpose context-aware bumps (CABs) that can support dynamic adaptation of form factors and functionality, systems and methods thereof. In one aspect, among others, a context-aware bump (CAB) system comprises a network of sensors distributed in a traffic network, the sensors communicatively coupled to a remotely located computing environment; a network of context-aware bumps (CABs) placed in the traffic network, the CABs communicatively coupled to the remotely located computing environment; and a CAB application executable in the remotely located computing environment, the CAB application configured to adjust a form factor of one or more CABs in the network of CABs in response to information obtained from the network of sensors, the network of CABs, or a combination thereof. Adjustment of the form factor can comprise changing a height of the one or more CABs, changing a width of the one or more CABs, or both. The height of the one or more CABs can be adjusted between a fixed number of incremental heights. The height of the one or more CABs can be adjusted to provide a road block. For example, the height can be dynamically adjusted to provide an intelligent and mild road block according to real-time traffic and/or pedestrian condition.

In various aspects, the information can comprise traffic information communicated to the remotely located computing environment from a vehicle. The form factor of the one or more CABs can be adjusted in response to real-time traffic information. The network of CABs can comprise a series of CABs placed in a thoroughfare. The series of CABs can comprise a plurality of individually controlled CABs. In some aspects, the network of CABs can be placed in a car rental center. At least one CAB of the network of CABs can be configured to display information to an operator of a vehicle. The at least one CAB can display the information through laser or holographic projection. The information can comprise traffic and pedestrian flow information.

In another aspect, a method comprises receiving, by a remotely located computing environment, traffic information from a network of sensors distributed in a traffic network or a network of context-aware bumps (CABs) placed in the traffic network; communicating, by the remotely located computing environment, a form factor control to at least one CAB of the network of CABs in response to the traffic information (e.g., road traffic flow, trajectory information, pedestrian information, traffic signal information, etc.); and in response to the form factor control, adjusting a form factor of the at least one CAB. The traffic information can comprise road vehicle flow and trajectory information over the traffic network, which can be communicated to the remotely located computing environment from a vehicle or vehicles. In one or more aspects, adjustment of the form factor can comprise changing a height or a width of the at least one CAB. The height of the at least one CAB can be adjusted to provide a road block (e.g., an intelligent and mild road block). The network of CABs can comprise a series of individually controllable CABs placed in a thoroughfare of the traffic network. In various aspects, the at least one CAB can display information in response to the form factor control. The at least one CAB can display the information through laser or holographic projection. The at least one CAB can display advertising information to an operator of a vehicle.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
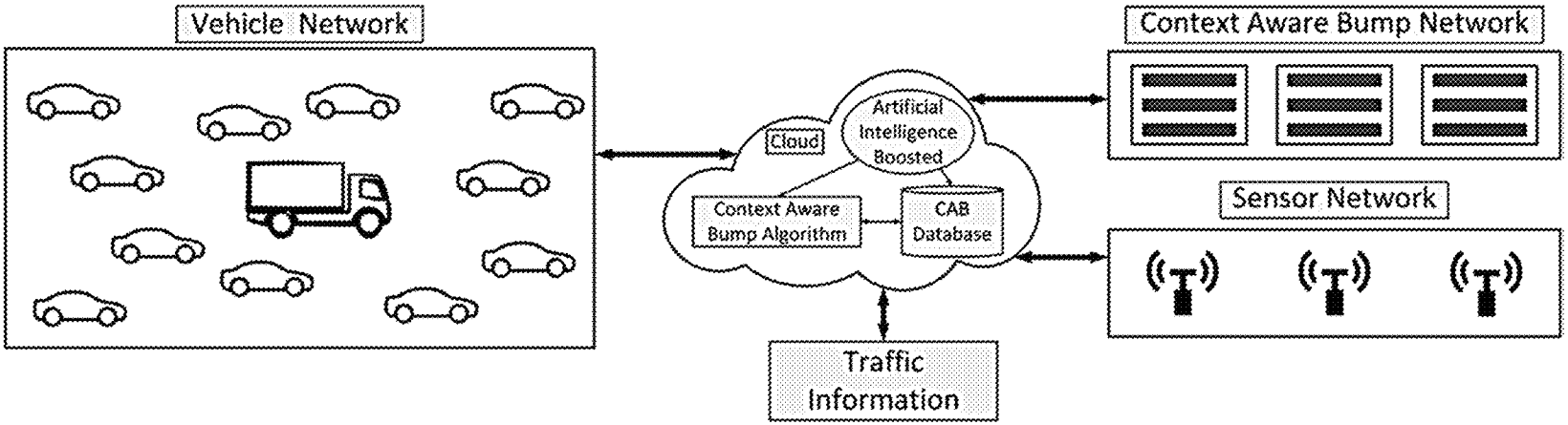
FIG. 1 is a graphical representation illustrating an example of the components of a context-aware bump (CAB) framework, in accordance with various embodiments of the present disclosure.

Disclosed herein are various examples related to multi-purpose context-aware bumps (CABs) that can support dynamic adaptation of form factors and functionality. Reference will now be made in detail to the description of the embodiments as illustrated in the drawings, wherein like reference numbers indicate like parts throughout the several views.

To address potentially fatal traffic issues that exist in many areas, a system and method is disclosed that can use a network of configurable intelligent multi-purpose context-aware speed bumps to mitigate accidents on pedestrians by reducing the speed of incoming cars as well as making the drivers alert as they move towards an intersection. The speed bumps can be connected among themselves as well as with the cloud. Such a network of context-aware bumps can also accomplish the following: (1) collect and/or transmit (e.g., to the cloud) accurate information on traffic such as, but not limited to, car type, speeds, numbers, etc. in a region, which can potentially enable more efficient traffic routing; and (2) provide a floating ad-space or information space, which can be programmed in real time to display in the air (e.g., in front of a car) critical information such as, but not limited to, car speed, accident, pedestrian, etc. or advertisements through laser or holographic projection from the bumps.

A system of one or more context-aware bump (CAB) can be strategically positioned in the roads using an optimization algorithm as will be discussed. A single CAB is a collection of multiple individual height and/or width adjustable fins (a unitary bump). A network of sensors can upload vehicle and pedestrian traffic information to a cloud application. The cloud application, with the help of artificial intelligence and optimization algorithms, can periodically update the CABs in the network (e.g., the height and/or width) based on known traffic and pedestrian information. The CABs can be fitted with LEDs and optionally hologram projectors to warn vehicles of upcoming CAB height and/or width changes. If a network of vehicles is in place, then optionally, information from the vehicles can also be used by the cloud application to make CAB adjustments.

Referring to FIG. 1, shown is a graphical representation illustrating an example of the different components at play in a CAB framework. The CAB system of FIG. 1 includes a network of CABs and a sensor network in communication with a cloud-based application. The cloud application can include a CAB data base and CAB algorithm for adjusting the CABs based upon, e.g., information from the sensor network and other traffic information (e.g., vehicular and pedestrian). Artificial intelligence can be utilized to boost or improve the decision making of the cloud application. The cloud application can also be in communication with a network of vehicles operating on the transportation (or traffic) network of streets, intersections, thoroughfares, etc.

Specific features of the proposed method and system will be described below. (1) A method can comprise installing a series of context-aware bumps (CABs) on a road which can dynamically and adaptively adjust the form factors (e.g., heights and/or widths) to reduce the speed of incoming cars according to traffic condition in context. (2) The CABs can be capable of interacting with sensors (e.g., cameras) installed in lamp posts or other strategic places near an intersection that can sense pedestrian movement. (3) The CABs can sense the speeds of incoming cars and communicate with the cloud application to decide, in real time, on the required form factors of the next set of CABs placed at commensurate distances from the intersection. (4) The CABs can project the recorded speed as well as a message on the road to alert the drivers for manual cars or autonomous vehicles in the future. (5) The CABs can be placed on roads inside neighborhood areas with children or elderly people. Cameras placed in strategic locations in the neighborhood can detect the presence of living beings and communicate with the cloud application to determine the appropriate form factors of the CABs and inform the CABs to control their form factors. (6) The system of CABs and audio/video/motion sensors can be installed at an intersection or strategic locations and, together with the cloud application, can provide pedestrian-aware dynamic intelligent and multi-functional speed bumps. (7) The speed bumps can be implemented with mechanical parts to adjust their heights and numbers (acting as multiple configurable fins, instead of one wide bump). Other features can include electronics for control and communication; integrated speed sensors; and rubber (or other flexible, strong, and resilient) bumps.

Figure 2:
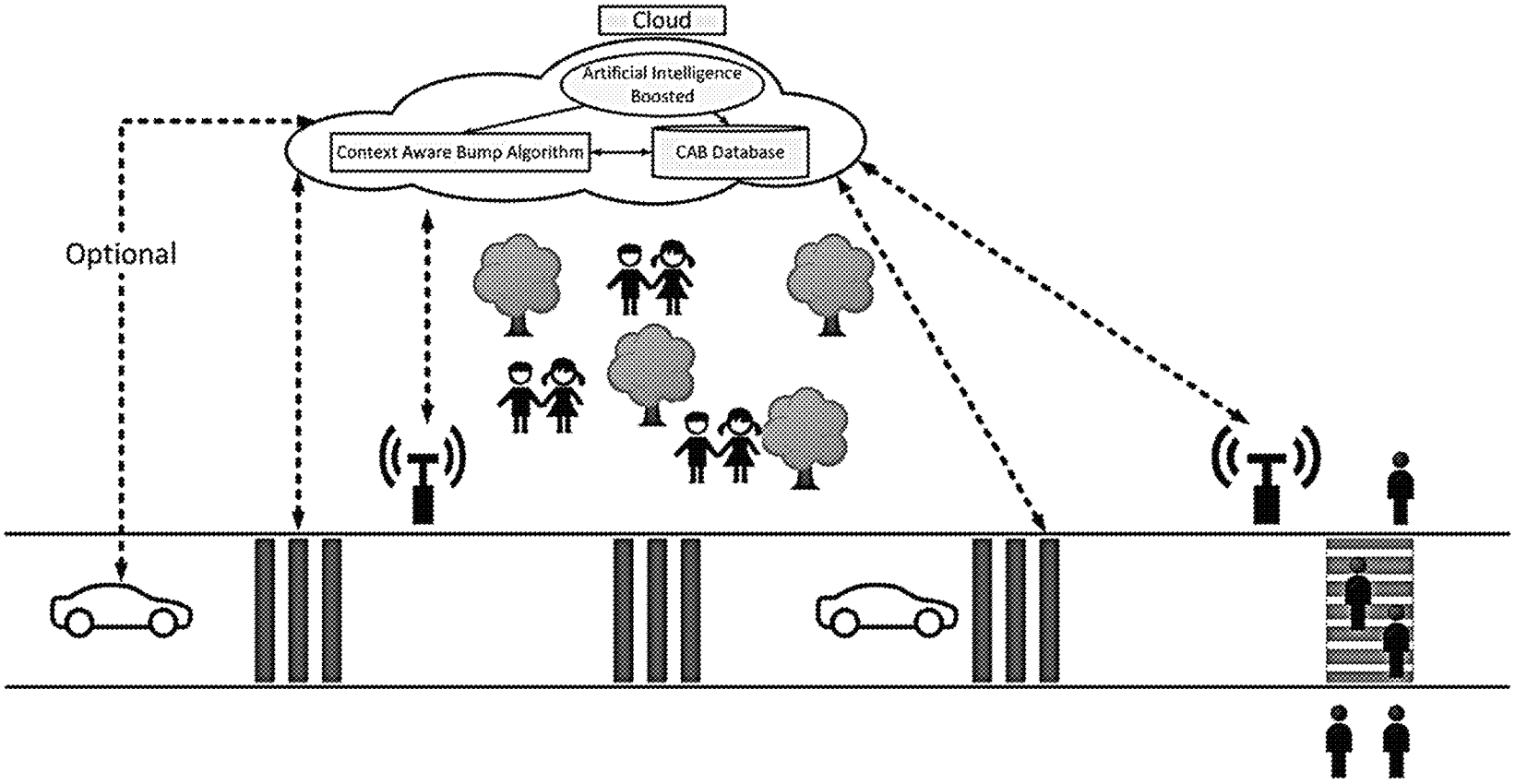
FIG. 2 is a graphical representation illustrating an example of an implementation of the CAB framework of FIG. 1, in accordance with various embodiments of the present disclosure.

FIG. 2 provides an overview illustrating an example of the CAB framework implementation. The sensor network can include sensors (e.g., cameras) distributed about the monitored thoroughfares to monitor for pedestrian and/or vehicular movement in the vicinity. The information can be communicated to the cloud application, where it can be utilized to determine the appropriate configuration of the CABs installed in the thoroughfare. The cloud application can communicate with the CABs to adjust their form factors (e.g., heights and/or widths) to control the vehicular traffic on the thoroughfare. In some implementations, the cloud application can be configured to communicate information to the vehicles regarding the current state of the traffic and/or the CABs, or changes in their conditions.

In various embodiments, the system can comprise the following components:

- A centralized/distributed cloud application that can control the entire system.
- A network of context-aware (speed) bumps, which can be in communication with and controlled by the cloud application.
- A network of sensors capable of tracking vehicle and pedestrian activities. The sensor networking is connected to the cloud application.
- Optionally, a network of cars or other vehicles in communication with the cloud application.

Note that the CAB network provides the potential benefit to improve pedestrian safety, but its companies with a potential cost to reduce traffic efficiency. This is mainly because the active CAB if not optimally placed and used can cause approaching vehicles to decelerate suddenly, which may lead to frequent shock waves propagating upstream and causes severe traffic fluctuation.

Figure 3:
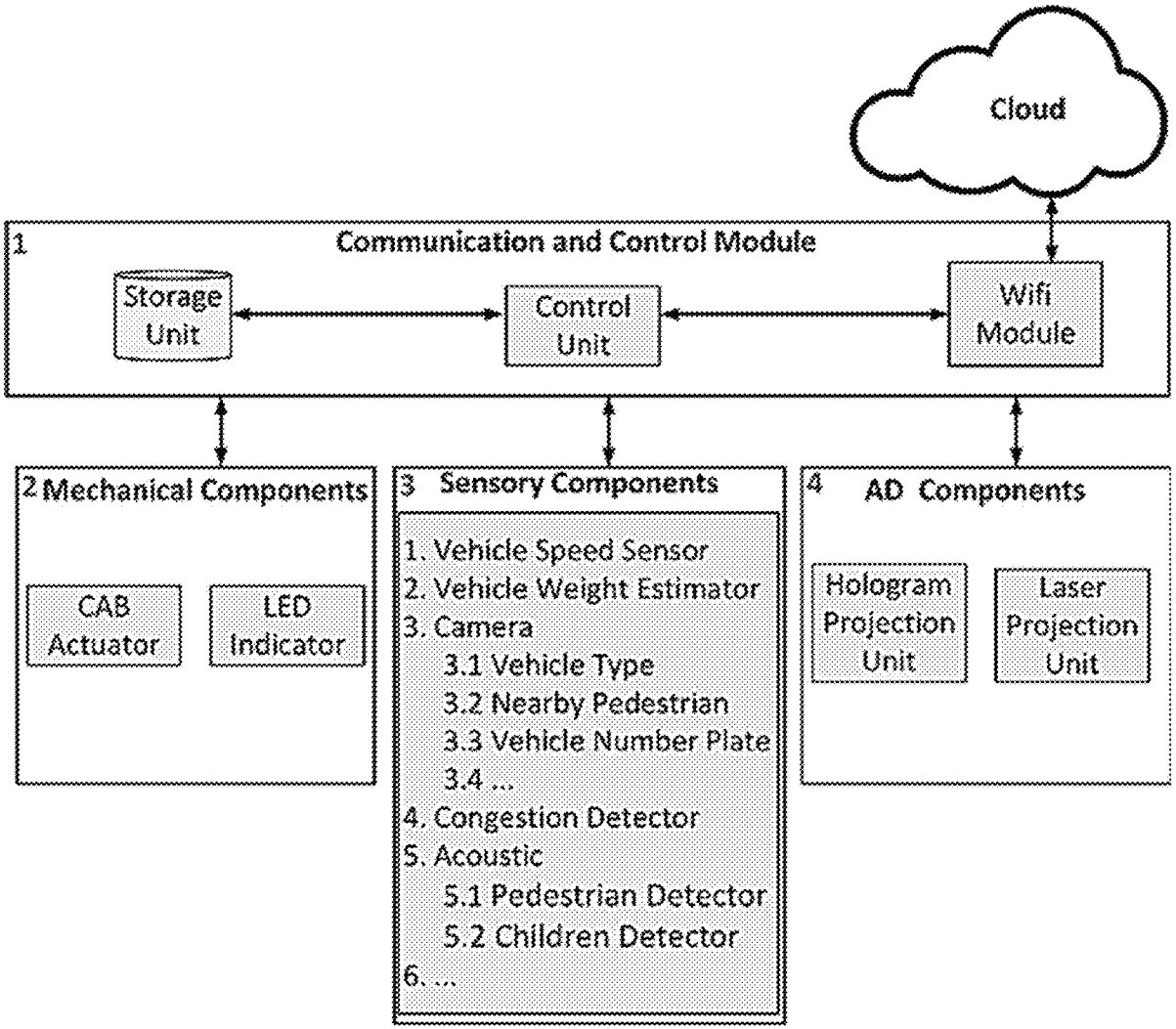
FIG. 3 is a schematic diagram illustrating an example of a CAB used in the CAB framework of FIG. 1, in accordance with various embodiments of the present disclosure.

FIG. 3 is a schematic diagram illustrating an example of an adaptive CAB for controlling traffic flow. Components of the CAB can include, but are not limited to:

(1) A communication and control module that can include processing circuitry for wireless communication with the cloud application and control of the CAB operation. The processing circuitry can comprise, e.g., a control unit having a processor or microcontroller, a storage unit comprising memory configured to store information or other data, and a wireless communication interface (or Wifi module) that allows for communication with the cloud application through a wireless link with, e.g., a LAN, cellular or other communication network.

(2) Mechanical components such as, e.g., the CAB actuator (or fin) that allows for adjustment of the form factor of the CAB and one or more indicators (e.g., a LED indicator) that can provide information about the CAB. The CAB actuator can be a height and/or width adjustable speed bump that can be controlled by the control unit.

(3) Sensory components that can be integrated into the CAB. Examples of sensor can include vehicle speed or proximity sensors, vehicle weight sensors, cameras configured to capture images that can be processed and/or analyzed to identify vehicle type or identification (e.g., license plates), pedestrians, or other information, congestion detectors, and/or acoustic detectors configured to capture (or record) noise that can identify or detect pedestrians, children, or other features proximate to the CAB. Information from the sensor components can be communicated to the cloud application and used for tracking vehicle and/or pedestrian activities.

(4) AD components such as, e.g., hologram or laser projection units that can provide visual displays of warnings, notices, advertisements, or other information.

Components of the network sensors can also include, but are not limited to, a communication and control module that can include processing circuitry for wireless communication with the cloud application and control of the sensor operation; and sensory components as described above and illustrated in FIG. 3.

Figure 4:
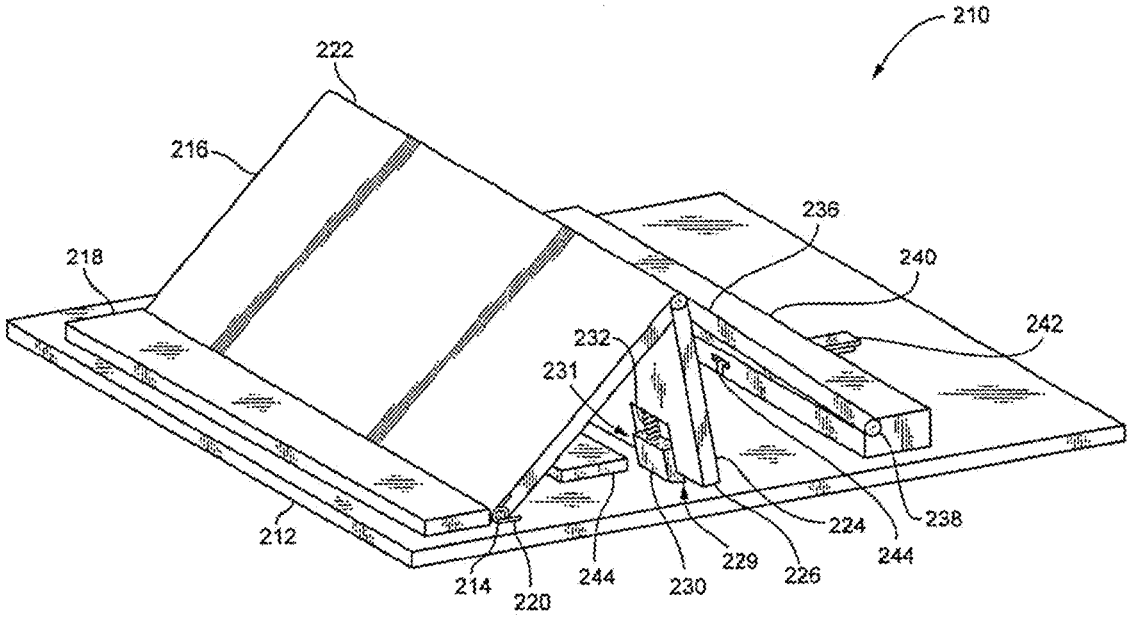
FIG. 4 illustrates an example of a mechanical actuator or fin of the CAB of FIG. 3, in accordance with various embodiments of the present disclosure.

FIG. 4 shows an example of a mechanical actuator or fin that can be used in the CAB. The mechanical design is describe in U.S. Pat. No. 6,457,900 ("Speed sensitive automatic speed bump" by M. L. Bond, Oct. 1, 2002), which is hereby incorporated by reference in its entirety. This actuator provides two levels of height adjustment (flat and fully raised). The CAB can utilize other types of mechanical actuators for adjustment of its form factor. For example, the proposed CAB actuator can be configured to incrementally or continuously adjust the height of the bump between flat and fully raised. Such fine-tuned adjustment allows the CAB to control traffic flow under a wide range of conditions. Initially the height and/or width of each CAB is set to a default value based on the traffic history information of the locality. The CAB can also be configured to control the width of the bump. The CAB can be flexible enough to integrate better or improved mechanical actuators as they are developed or to achieve different functional options.

Figure 5:
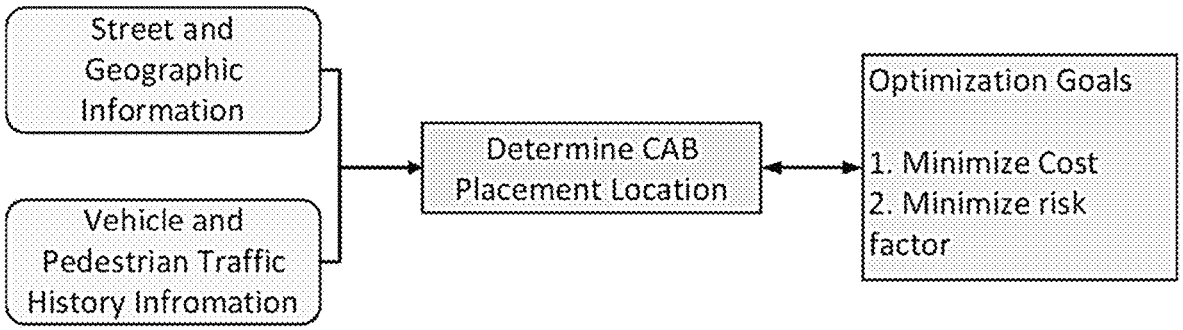
FIG. 5 is a flow diagram illustrating an example of a process for determining CAB placement, in accordance with various embodiments of the present disclosure.
Figure 6:
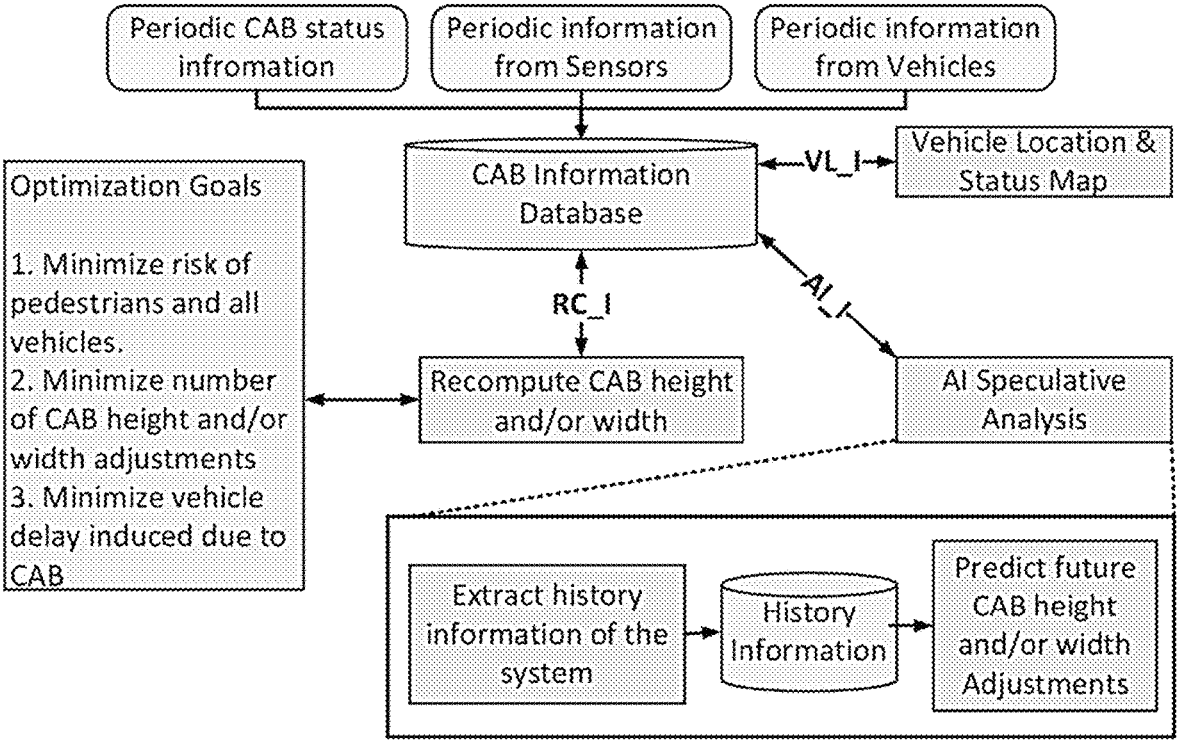
FIG. 6 is a flow diagram illustrating an example of a process for CAB operation, in accordance with various embodiments of the present disclosure.

To make the CAB network work for both traffic efficiency and pedestrian safety considerations, the height and width as well as the locations of the CABs are strategically determined by considering their traffic effect so that they slow down traffic gradually and smoothly rather than cause significant traffic fluctuations. Consider that the height and width of each CAB fin will affect the deceleration rate (the magnitude of traffic fluctuation), and the distribution and/or cooperation of the CAB fins along the length (or longitude) of the road or thoroughfare stretching to the intersection will affect the propagation of the traffic fluctuation occurring at each CAB fin. Optimization models can be combined with comprehensive traffic flow analysis to provide improved or optimal CAB placement solutions and height/width adjustments of each CAB depending on the traffic scenario instance. FIG. 5 shows a flow diagram illustrating an algorithm for determining an optimal CAB placement solution and FIG. 6 shows a flow diagram illustrating an algorithm for CAB operation for controlling height and/or width of the CAB depending on the traffic scenario instance.

CAB Insertion.

Consider the CAB placement algorithm of FIG. 5. The bump insertion can work as follows:

A first input (Input 1) includes street and geographical information extracted from satellite images or from an exciting dataset.

A second input (Input 2) includes traffic database containing information about vehicle flow for different times of the day and year. The second input can include both historical traffic information and real-time traffic information. Record of previous accidents and traffic violations.

Based the first and second inputs, the CAB placement algorithm determines: (1) where to place each CAB; (2) how many fins each CAB should have; and (3) default height and/or width of the CAB fins. The information can include both real-time traffic information and historical traffic information. Historical data can provide default height and width and real-time data can be used to adjust the CAB adaptively according to real-time traffic and/or pedestrian conditions Risk not only accounts for risk to the pedestrian but also takes into consideration the risk posed to the car and the driver. The placement algorithm can take into account the comfort of the vehicle passenger while maintaining pedestrian safety. The effect of speed bumps on the vehicle can be considered, and solutions to deal with the problem provided.

CAB Operation.

With the placement of the CAB operation algorithm of FIG. 6. The operational control can work as follows:

Periodic information from CABs, sensors and/or vehicles can be recorded and sent to the cloud application for being stored in the CAB information database.

With a periodicity of VL_I, vehicle location, speed, acceleration, trajectory, vehicle type can be processed and updated in the database.

With a periodicity of AI_I, traffic history information can be processed to predict future CAB adjustment needs. The historical traffic information can be combined with real-time traffic information (e.g., real-time traffic and/or pedestrian conditions). This can be accomplished using AI speculative analysis. For example, exact history information of the system can be retained (or stored) as history information which can be used as reference to predict future CAB adjustments once the system obtains new traffic/pedestrian context data.

The CAB information database can contain all necessary information needed to compute CAB height and/or width adjustments given any scenario.

With a periodicity of RC_I, the CAB height and/or width can be recomputed and adjusted if needed to meet all the optimization goals.

CAB Adjustment Model Operation Stages.

Based on the traffic and pedestrian situation some or all of the CABs in a locality can adjust their height and/or width. If it is deemed needed by the cloud application to slow down a particular vehicle then a subset of CABs in the locality will have to adjust themselves based on the vehicle type, speed and other parameters. This leads to the question of determining the height and/or width for each CAB fins for a set of CABs for a given scenario. For each new CAB deployed in the system, it can go through a calibration phase and once properly calibrated it can be deemed fully functional.

Figure 7:
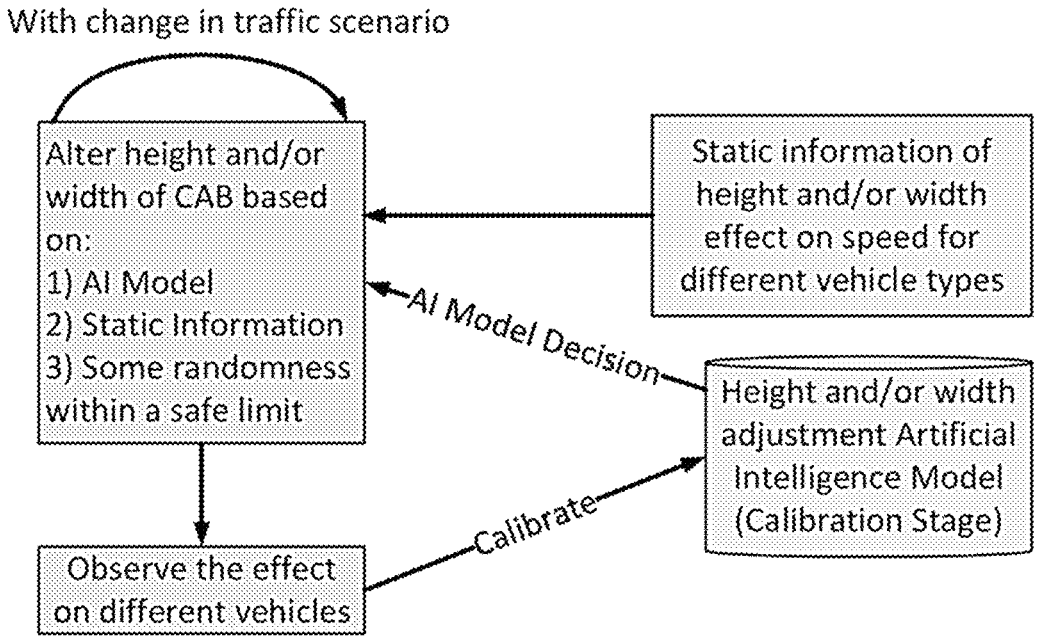
FIGS. 7 and 8 are flow diagrams illustrating examples of processes for CAB adjustment model calibration and operation, in accordance with various embodiments of the present disclosure.

Height and/or width adjustment model operation during calibration phase (as shown in FIG. 7) works as follows:

A database of static information can be maintained and made available which contains information about what height and/or width adjustments may be needed for different types of vehicles in different scenarios. This information can be obtained from previously trained models being used in other CABs and/or from research articles related to speed bumps.

A dynamic artificial intelligence (AI) model can be deployed to aid in the CAB height and/or width adjustment decision making, which can be according to real-time traffic and/or pedestrian conditions. The dynamic model can observe the effect of the decision and continuously tunes itself to perform better.

As the traffic scenario changes, the height and/or width of some or all of the CABs in the network can be adjusted based on the static information, the AI model decision, and/or real-time collected data. On top of the collective decision, some small amount of randomness can be introduced to allow the AI model to learn the effect of the CABs better. This randomness can be a small increase and/or decrease in height and/or width of the CAB fins in addition to the collective decision made by using the static information and the AI model decision.

After observing the effect and/or feedback of the CABs on the vehicles, the AI model is calibrated and/or tuned to perform better. The feedback can be in terms of (1) how smooth was the vehicles retardation to infer the comfort level of the vehicle passengers, (2) how effective were the CABs in terms of reducing the speed of the vehicle, etc.

This process can continue until certain conditions are met in terms of the effectiveness of the newly installed CAB or set of CABs.

Figure 8:
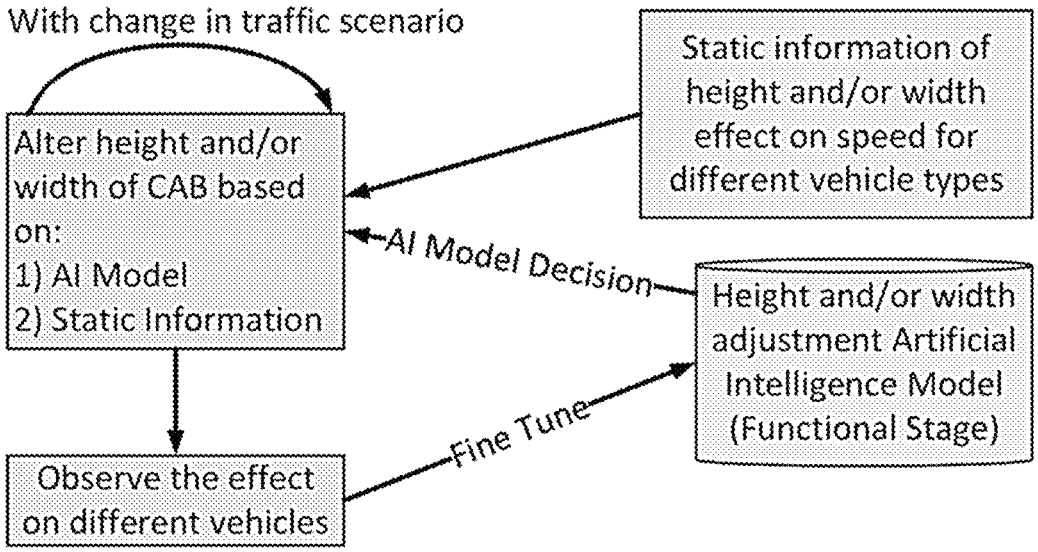

Once the height and/or width adjustment model operation calibration phase is over, the newly install CABs or set of CABs can start to operate in a normal functional mode as shown in FIG. 8. The AI model can continue to be fine-tuned based on the feedback and decision making in FIG. 8.

First CAB Operation Scenario.

Figure 9:
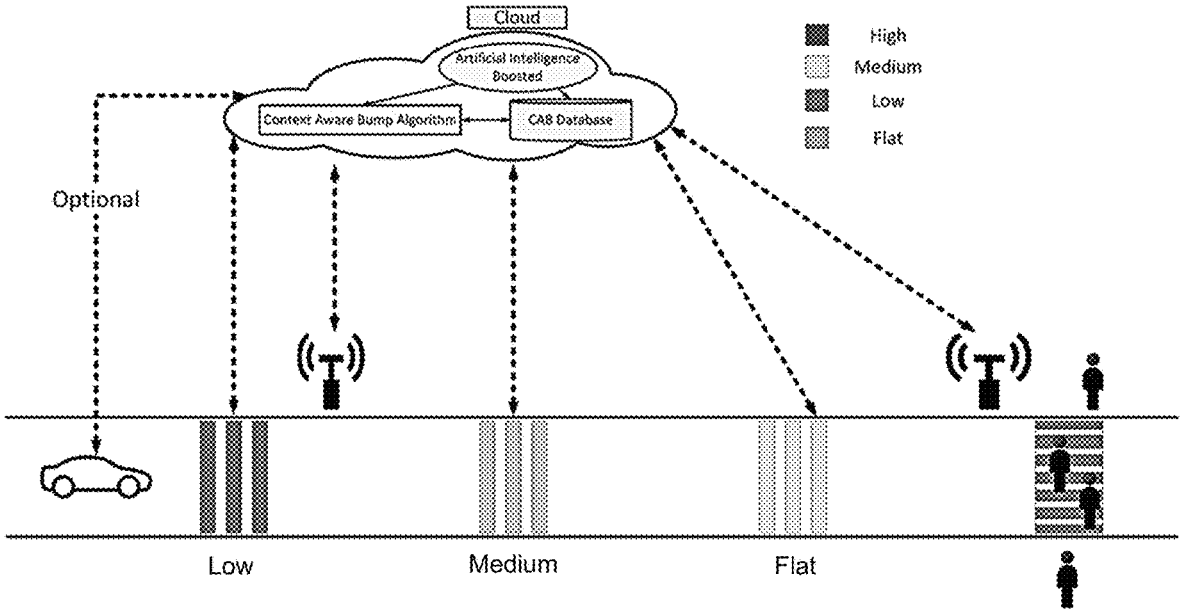
FIGS. 9 and 10 are graphical representations illustrating examples of CAB operation scenarios in the CAB framework of FIG. 1, in accordance with various embodiments of the present disclosure.

FIG. 9 illustrates a first operational scenario of the CAB framework of FIG. 2. In this example, there are four possible levels of CAB height (high, medium, low and flat), but more or fewer levels (or a continuous variation) can be implemented. For simplicity, the width of the CABs are held fixed for the scenario.

In the example of FIG. 9, a small car is observed moving towards a pedestrian crossing.

The sensor can estimate the speed, acceleration and momentum of the car and sends the information to the cloud application. Alternatively, the cloud application can estimate the vehicle information using data from the sensor network.

As the car is small, the cloud application can decide to set some or all the fins of the first CAB to a low height to slow the car down a little.

The second set of CAB fins can be set to medium height to completely slow the car down.

In this example, the third set of CAB fins are not used for this scenario and are kept flat.

Second CAB Operation Scenario.

Figure 10:
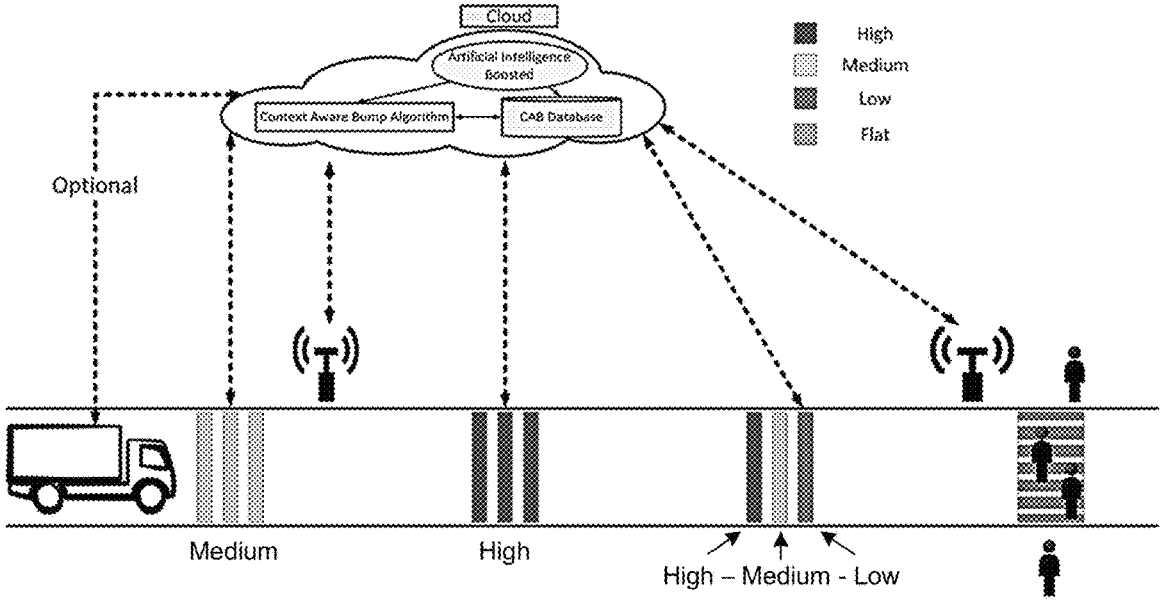

FIG. 10 illustrates a second operational scenario of the CAB framework. As in the example of FIG. 9, four possible levels of CAB height (high, medium, low and flat) and a fixed width are utilized.

In the example of FIG. 10, a truck is observed moving towards a pedestrian crossing.

The sensor can estimate the speed, acceleration and momentum of the truck and sends the information to the cloud application. Alternatively, the cloud application can estimate the vehicle information using data from the sensor network.

As the truck is much bigger than the car in the scenario of FIG. 9, the cloud application can decide to set all the fins of the first CAB to a medium height to slow the truck down a little.

The second set of CAB fins can be set to all high heights to completely slow the truck down.

The third set of CAB fins can be set to a series of different heights (high-medium-low) to make sure that the truck maintains a slow pace.

As can be understood, other combinations of CABs and height and/or width adjustments can be utilized to slow down traffic.

This disclosure has presented various examples related to context-aware bumps (CABs) that can support dynamic adaptation of form factors and functionality of the CABs. A framework capable of operating the CAB network using a cloud application can be devised. A network of height and/or width adjustable CAB can be operated based on information from a cloud application.

Context-aware speed bumps can have multiple fins (one unitary bump), each of which can be capable of independently changing its height and/or width. The granularity of the height and/or width change can ideally be infinitesimally small. In other words, if the maximum height is $h_1$ and the minimum height is $h_2$, then between $h_1$ and $h_2$, there can be ideally infinitely many levels. Similarly, if the maximum width is $w_1$ and the minimum width is $w_2$, then between $w_1$ and $w_2$, there can be ideally infinitely many levels. The number of such levels in a real instance will depend on the physical implementation of the CAB.

A sensor network can be used to feed traffic information to the cloud application. Optionally, if the vehicles are capable of transferring information to the cloud application, then that information can also be used for decision making. Real-time traffic information can be fetched and can be used by the cloud application for making optimized decisions. The cloud application can be capable of making optimized height and/or width alterations for each CAB in the network for any given time instance. Goals of the cloud application can include (1) minimizing risk, (2) minimizing the number of CAB height and/or width alterations, and/or (3) minimizing vehicle delay. LED flashing lights can be fitted on the CABs to warn vehicles about upcoming height and/or width adjustments.

Self-Aware Repairing:

The network of CABs can coordinate with each other and evaluate the status of each other (e.g., if the mechanical movement of the bumps is fine) and then inform the cloud application. One way to do this evaluation would be to check how much the speed reduces by a bump for a specific configuration, as sensed by the next bump for a large number of cars.

Use of CAB as Road Block:

A set of CABs can be configured to act as a roadblock. These CABs can create a roadblock on demand to prevent vehicles from moving forward in case of an accident or dangerous road condition, where a detour is needed. For example, the CABs can provide an intelligent and mild road block that can avoid the presence of a sudden bumper, which can cause safety issues for cars or other vehicles, and can also significantly affect traffic. These CABs can be configured to project necessary information on the reason for roadblock and detour routes, etc. These on-demand roadblocks can be instructed by the control unit in the cloud (e.g., to be managed by responsible state/city traffic administration or law enforcement) can eliminate the need for police cars to be placed on ramps to the highway or other locations in the road to block incoming traffic on critical situations, described before. In some embodiments, CABs can be used in car rental centers to sense the car data on exit or entry (e.g., during return) and also to project information.

Floating On-the-Fly Programmable, Personalized Ad Space:

CABs can be used as a configurable ad Space. The CAB can be configured and/or programmed by a control system placed in the cloud to display various advertisements (along with critical information on road accidents, road work, weather conditions, etc.) through an on-air laser projection mechanism. These advertisements can be personalized to a specific driver and/or rider in a vehicle which can be sensed by a CAB (or the sensor network), which can then inform the next CAB, or can be adjusted to a specific traffic patterns and/or time of the day (e.g., lunch hour traffic in an office complex can be interested in lunch menus of nearby restaurants, or parking locations for cars near a beach, etc.). These advertisements can be displayed in a manner that does not cause a traffic safety issue. For instance, in the case of manually operated cars, advertisements can be displayed when a car is waiting on a red signal. For autonomous cars, advertisements can be displayed on the road while the car is in motion. Optionally, a hologram can be projected from a CAB to warn oncoming vehicles about upcoming height and/or width adjustments.

Network of CABs:

The network of CABs and sensors as more accurate and real-time traffic monitoring and control system: The network of CABs in a region, in a collaborative manner, can share information through the cloud about traffic patterns, vehicular speeds, accidents, etc. for better traffic signal control and routing guidance, and to provide more accurate information on traffic conditions. The recorded data can be combined with satellite and GPS data to optimize the traffic routing in case of autonomous cars and/or to alert drivers on a better choice of routes given traffic and/or weather conditions. In various implementations, a physical flexible bump with dynamically adjustable height and width can be used. In other embodiments, a holographic or other 3-D display can be utilized based virtual bump, which can project on air a 3-D realistic image of a bump of different heights and width. Existing bumps can be replaced with these multi-functional intelligent CABs.

Figure 11:
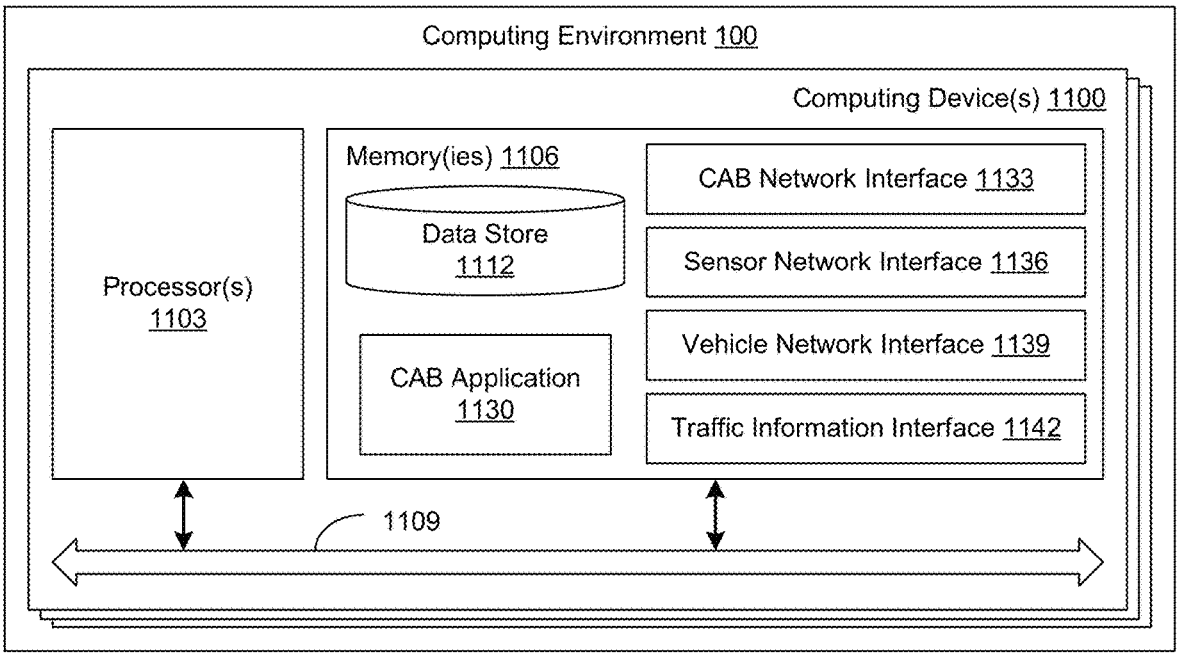
FIG. 11 is a schematic block diagram that provides one example illustration of a computing environment employed in the networked environment of FIGS. 1-3, 9 and 10, in accordance with various embodiments of the present disclosure.

With reference to FIG. 11, shown is a schematic block diagram of the computing environment 100 (e.g., the networked environment ("cloud") of FIGS. 1-3, 9 and 10) according to an embodiment of the present disclosure. The computing environment 100 includes one or more computing devices 1100. Each computing device 1100 includes at least one processor circuit, for example, having a processor 1103 and a memory 1106, both of which are coupled to a local interface 1109. To this end, each computing device 1100 may comprise, for example, at least one server computer or like device. The local interface 1109 may comprise, for example, a data bus with an accompanying address/control bus or other bus structure as can be appreciated.

Stored in the memory 1106 are both data and several components that are executable by the processor 1103. In particular, stored in the memory 1106 and executable by the processor 1103 are the CAB application 1130, and potentially other applications. Various interfaces can also be stored for communication with networks or other sources of information. The interfaces can include, e.g., a CAB network interface 1133, a sensor network interface 1136, a vehicle network interface 1139, and a traffic information interface 1142, and potentially other applications. Also stored in the memory 1106 may be a data store 1112 and other data. In addition, an operating system may be stored in the memory 1106 and executable by the processor 1103.

It is understood that there may be other applications that are stored in the memory 1106 and are executable by the processor 1103 as can be appreciated. Where any component discussed herein is implemented in the form of software, any one of a number of programming languages may be employed such as, for example, C, C++, C#, Objective C, Java®, JavaScript®, Perl, PHP, Visual Basic®, Python®, Ruby, Delphi®, Flash®, or other programming languages.

A number of software components are stored in the memory 1106 and are executable by the processor 1103. In this respect, the term "executable" means a program file that is in a form that can ultimately be run by the processor 1103. Examples of executable programs may be, for example, a compiled program that can be translated into machine code in a format that can be loaded into a random access portion of the memory 1106 and run by the processor 1103, source code that may be expressed in proper format such as object code that is capable of being loaded into a random access portion of the memory 1106 and executed by the processor 1103, or source code that may be interpreted by another executable program to generate instructions in a random access portion of the memory 1106 to be executed by the processor 1103, etc. An executable program may be stored in any portion or component of the memory 1106 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 1106 is defined herein as including both volatile and nonvolatile memory and data storage components. Volatile components are those that do not retain data values upon loss of power. Nonvolatile components are those that retain data upon a loss of power. Thus, the memory 1106 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 1103 may represent multiple processors 1103 and the memory 1106 may represent multiple memories 1106 that operate in parallel processing circuits, respectively. In such a case, the local interface 1109 may be an appropriate network that facilitates communication between any two of the multiple processors 1103, between any processor 1103 and any of the memories 1106, or between any two of the memories 1106, etc. The local interface 1109 may comprise additional systems designed to coordinate this communication, including, for example, performing load balancing. The processor 1103 may be of electrical or of some other available construction.

Although the CAB application 1130, CAB network interface 1133, sensor network interface 1136, vehicle network interface 1139, traffic information interface 1142, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flow diagrams of FIGS. 5-8 show functionality and operation of an implementation of portions of the CAB application 1130. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 1103 in a computer system or other system. The machine code may be converted from the source code, etc. If embodied in hardware, each block may represent a circuit or a number of interconnected circuits to implement the specified logical function(s).

Although the flow diagrams of FIGS. 5-8 show a specific order of execution, it is understood that the order of execution may differ from that which is depicted. For example, the order of execution of two or more blocks may be scrambled relative to the order shown. Also, two or more blocks shown in succession in FIGS. 5-8 may be executed concurrently or with partial concurrence. Further, in some embodiments, one or more of the blocks shown in FIGS. 5-8 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the CAB application 1130, CAB network interface 1133, sensor network interface 1136, vehicle network interface 1139, traffic information interface 1142, that comprises software or code can be embodied in any non-transitory computer-readable medium for use by or in connection with an instruction execution system such as, for example, a processor 1103 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A context-aware bump (CAB) system, comprising:

a network of sensors distributed in a traffic network, the sensors communicatively coupled to a remotely located computing environment;

a network of context-aware bumps (CABs) placed in the traffic network, the CABs communicatively coupled to the remotely located computing environment, and the network of CABs comprising a plurality of independently controlled CABs; and a CAB application executable in the remotely located computing environment, the CAB application configured to adjust a form factor of one or more CABs in the network of CABs in response to information obtained from the network of sensors, the network of CABs, or a combination thereof.

2. The CAB system of claim 1, wherein adjustment of the form factor comprises changing a height of the one or more CABs.

3. The CAB system of claim 2, wherein the height of the one or more CABs is incrementally adjusted between a fixed number of incremental heights between flat and fully raised.

4. The CAB system of claim 2, wherein the height of the one or more CABs is adjusted to provide a road block.

5. The CAB system of claim 1, wherein adjustment of the form factor comprises changing a width of the one or more CABs.

6. The CAB system of claim 1, wherein the information comprises traffic information communicated to the remotely located computing environment from a vehicle.

7. The CAB system of claim 1, wherein the form factor of the one or more CABs is adjusted in response to real-time traffic information.

8. The CAB system of claim 1, wherein the network of CABs comprise a series of CABs placed in a thoroughfare, the series of CABs distributed along a length of the throughfare.

9. The CAB system of claim 8, wherein the series of CABs comprises a plurality of individually controlled CABs.

10. The CAB system of claim 1, wherein the network of CABs is placed in a car rental center.

11. The CAB system of claim 1, wherein at least one CAB of the network of CABs is configured to display information to an operator of a vehicle.

12. The CAB system of claim 11, wherein the at least one CAB displays the information through laser or holographic projection.

13. The CAB system of claim 1, wherein the information comprises traffic and pedestrian flow information.

14. A method, comprising:

receiving, by a remotely located computing environment, traffic and pedestrian flow information from a network of sensors distributed in a traffic network or a network of context-aware bumps (CABs) placed in the traffic network;

communicating, by the remotely located computing environment, a form factor control to at least one CAB of the network of CABs in response to the traffic information; and in response to the form factor control, adjusting a form factor of the at least one CAB.

15. The method of claim 14, wherein the traffic information comprises road vehicle flow and trajectory information over the traffic network.

16. The method of claim 14, wherein adjustment of the form factor comprises changing a height or a width of the at least one CAB.

17. The method of claim 16, wherein the height of the at least one CAB is adjusted to provide a road block.

18. The method of claim 14, wherein the network of CABs comprises a series of individually controllable CABs placed in a thoroughfare of the traffic network, the series of CABs distributed along a length of the throughfare.

19. The method of claim 14, wherein the at least one CAB displays information in response to the form factor control.

20. The method of claim 14, wherein the at least one CAB displays advertising information to an operator of a vehicle.

* * * * *